US010197268B2

(12) United States Patent
Hansen et al.

(10) Patent No.: US 10,197,268 B2
(45) Date of Patent: Feb. 5, 2019

(54) SELF EXTINGUISHING TORCH CANISTER

(71) Applicant: LAMPLIGHT FARMS INCORPORATED, Menomonee Falls, WI (US)

(72) Inventors: Lars Hansen, Holstebro (DK); Robert Woodruff, Oconomowoc, WI (US)

(73) Assignee: Lamplight Farms Incorporated, Menomonee Falls, WI (US)

( * ) Notice: Subject to any disclaimer, the term of this patent is extended or adjusted under 35 U.S.C. 154(b) by 230 days.

(21) Appl. No.: 15/065,489

(22) Filed: Mar. 9, 2016

(65) Prior Publication Data

US 2017/0261202 A1 Sep. 14, 2017

(51) Int. Cl.
*F23D 3/26* (2006.01)

(52) U.S. Cl.
CPC ..... *F23D 3/26* (2013.01)

(58) Field of Classification Search
CPC ... F23D 3/26; F23D 3/32; F23Q 25/00; F21V 37/002; F21V 37/0008; F23N 5/247
USPC ..... 431/319–324, 289
See application file for complete search history.

(56) References Cited

U.S. PATENT DOCUMENTS

| | | | | |
|---|---|---|---|---|
| 1,189,826 | A | 4/1877 | Wood | |
| 412,969 | A | 10/1889 | Miller | |
| 481,268 | A | 8/1892 | Price | |
| 921,633 | A | 5/1909 | Stokes et al. | |
| 2,022,897 | A | 12/1935 | Neumeister | |
| 4,039,274 | A * | 8/1977 | Nordlinger | F23Q 2/285 431/128 |
| 6,398,545 | B1 | 6/2002 | Kleeman et al. | |
| 2001/0053504 | A1 | 12/2001 | Lu | |
| 2009/0068608 | A1 | 3/2009 | Hansen | |
| 2010/0255436 | A1 | 10/2010 | Lu | |
| 2016/0327269 | A1 | 11/2016 | Hansen et al. | |
| 2016/0327270 | A1 | 11/2016 | Hansen | |

FOREIGN PATENT DOCUMENTS

| | | |
|---|---|---|
| DE | 4304970 | 10/2016 |
| JP | 58158427 | 9/1983 |
| WO | WO2010040155 A2 | 4/2010 |

OTHER PUBLICATIONS

"International Search Report and Written Opinion prepared by the ISA/US in PCT/US2017/020644 completed Apr. 28, 2017", "International Search Report and Written Opinion prepared by the ISA/US in PCT/US2017/020644 completed Apr. 28, 2017".

* cited by examiner

*Primary Examiner* — Avinash Savani
*Assistant Examiner* — Rabeeul Zuberi
(74) *Attorney, Agent, or Firm* — David G. Woodral; GableGotwals

(57) ABSTRACT

A self extinguishing torch mechanism has a stationary tube with an opening at an upper end thereof, and a wick tube concentrically rigidly affixed inside the stationary tube defining a space therebetween. A sliding tube is situated coaxially around wick tube the within the space defined between the wick tube and stationary tube. A biasing member extends the sliding member through the opening at the upper end of the stationary tube when the stationary tube is overturned.

16 Claims, 11 Drawing Sheets

SELF EXTINGUISHING TORCH CANISTER

BACKGROUND OF THE INVENTION

Liquid fueled torches are utilized for a number of purposes such as lighting, decoration, and pest repellence. This disclosure relates to liquid fueled torches with added features.

SUMMARY OF THE INVENTION

The invention of the present disclosure, in one aspect thereof, comprises a self extinguishing torch mechanism having a stationary tube with an opening at an upper end thereof, and a wick tube concentrically rigidly affixed inside the stationary tube defining a space therebetween. A sliding tube is situated coaxially around wick tube the within the space defined between the wick tube and stationary tube. A biasing member extends the sliding member through the opening at the upper end of the stationary tube when the stationary tube is overturned.

The self extinguishing torch mechanism may also include a cap affixed at an upper end of the stationary tube and retaining the stationary tube at least partially inside a liquid fuel reservoir. A shelf may reside between the stationary tube and the wick tube demarcating a lower end of the space defined between the stationary tube and wick tube.

In some embodiments, a flange on a lower portion of the sliding tube, and extending away from the sliding tube, interfaces with the biasing member. A lip may circumscribe the opening on the upper end of the stationary tube defining the opening at a size that allows an upper portion of the sliding tube to extend through the opening but retain the flange within the stationary tube. The biasing member may comprise a coil spring surrounding the wick tube and pressing against the shelf and the flange to provide an upward extending force to the sliding tube when the sliding tube contacts the coil spring. The biasing member may extend the sliding tube beyond the wick tube by a distance that is at least twice an internal diameter of the wick tube.

Some embodiments of the self extinguishing torch mechanism include a remote snuffer cap situated superior to the wick tube such that the sliding tube contacts the remote snuffer cap when extended by the biasing member when the stationary tube is overturned.

The invention of the present disclosure, in another aspect thereof, comprises a self extinguishing torch canister including a liquid torch fuel reservoir, and a cap atop the liquid fuel torch reservoir retaining a self extinguishing mechanism at least partially inside the liquid fuel torch reservoir. The self extinguishing mechanism may comprise a stationary tube affixed to the cap and defining an opening through the cap. A wick tube is retained inside the stationary tube providing passage for a wick from outside the liquid torch fuel reservoir to inside the liquid torch fuel reservoir. A space is defined inside the stationary tube and between the stationary tube and the wick tube. A sliding tube surrounds the wick tube and is freely slidable on the wick tube to extend through the opening through the cap. A biasing member providing an upward biasing force against the siding tube. The sliding tube acts against the biasing member under force of gravity to remain in a first retracted position relative to the stationary tube when the liquid torch fuel reservoir remains upright. The sliding tube has a second extended position where the sliding tube is extended through the opening through the cap and beyond the wick tube by a distance at least twice an inside diameter of the wick tube.

In some embodiments, the cap and the liquid torch fuel reservoir are threaded to allow the cap and the self extinguishing mechanism to be selectively attached and detached from the liquid torch fuel reservoir. The liquid torch fuel reservoir may have a maximum fuel fill level that is higher inside the liquid fuel torch reservoir than a lower depth of the self extinguishing mechanism.

The sliding tube may be forced by the biasing member to extend through the opening through the cap to the second extended position when the liquid torch fuel reservoir departs from upright by greater than a predetermined angle. In other embodiments, the sliding tube is forced by the biasing member to extend through the opening through the cap to the second extended position when the liquid torch fuel reservoir departs from upright by greater than a predetermined angle and impacts a ground surface. The biasing member may comprise a coil spring wound around the wick tube.

In some embodiments, a flange is provided on the sliding tube. The flange at least partially compresses the coil spring when the liquid torch fuel reservoir is in an upright position. A lip may be provided on the stationary tube. The lip being sized to retain the flange and prevent the sliding tube from completely escaping the stationary tube. A shelf on a lower portion of the wick tube may connect the wick tube to the stationary tube and provide a lower bearing surface for the coil spring.

The self extinguishing torch canister may include a stationary snuffer affixed to the cap providing a remote snuffer cap superior to the wick tube such that the sliding tube contacts the remote snuffer cap when the sliding tube is in the second extended position.

The invention of the present disclosure, in another aspect thereof, comprises a method of self extinguishing a liquid fuel burning torch. The method includes providing a wick tube providing passage of a wick into a liquid fuel reservoir, and providing a sliding tube surrounding the wick tube that is biased to extend beyond the wick at least twice as far as the diameter of the wick if the liquid fuel burning torch departs from upright by more than a predetermined angle. The method further includes enclosing the wick tube and the sliding tube in a stationary tube with an opening that allows the sliding tube to extend therefrom, and fixing the stationary tube to the liquid fuel reservoir such that a majority of the stationary tube is contained inside the liquid fuel reservoir.

The method may also include forming an upper end of the stationary tube into a lip and a lower end of the sliding tube into a flange such that the lip catches the flange to prevent the stationary tube from escaping the stationary tube completely.

BRIEF DESCRIPTION OF THE DRAWINGS

To easily identify the discussion of any particular element or act, the most significant digit or digits in a reference number refer to the figure number in which that element is first introduced.

DETAILED DESCRIPTION OF THE PREFERRED EMBODIMENTS

Figure 1:
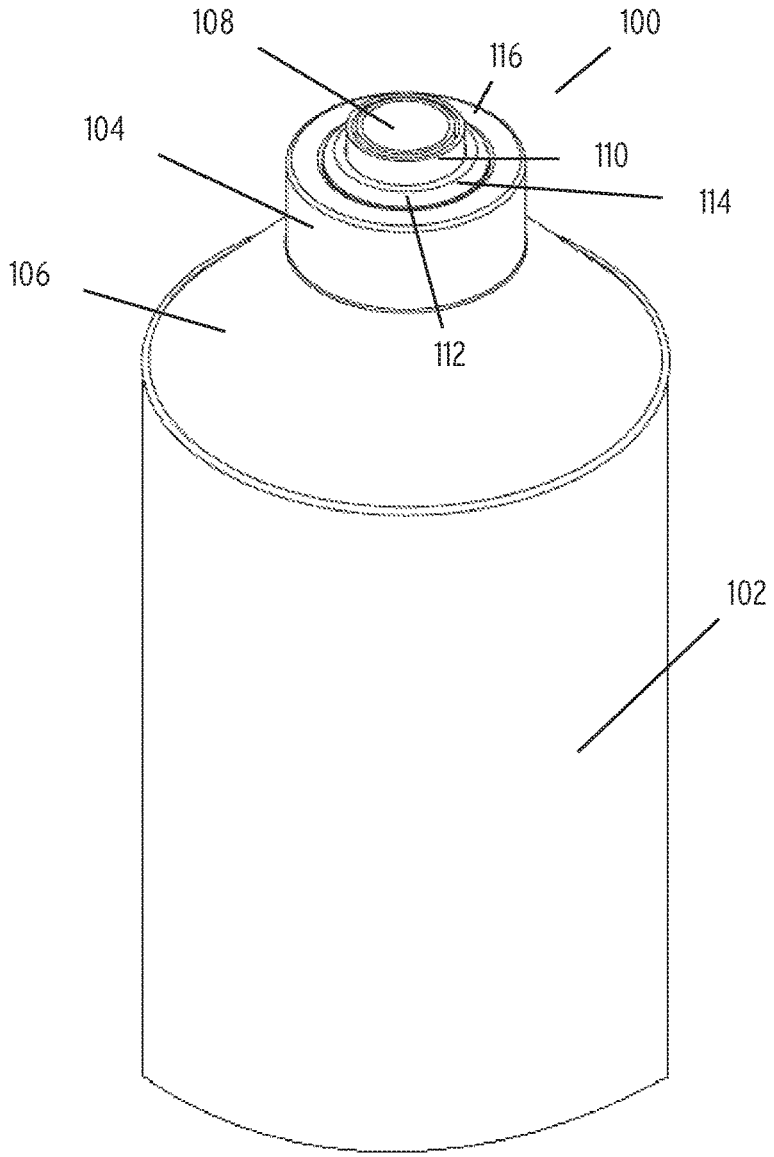
FIG. 1 is a perspective view of one embodiment of self extinguishing canister for a liquid fuel burning torch according to aspects of the present disclosure.

Referring now to FIG. 1, a self extinguishing canister 100 according to the present disclosure is shown. The canister 100 includes a fuel reservoir 102 that may be covered by a tapered skirt 106. The skirt 106 may be integrated with a cap 104 retaining a self extinguishing mechanism 114. The skirt 106 may extend beyond the sides of the fuel reservoir 102 to provide for mounting or retention of the self extinguishing canister 100 in a table or lawn torch receptacle or the like.

The skirt 106 may be removable from the fuel reservoir 102 or may be fixed thereto. The skirt 106 and the fuel reservoir 102 may comprise rolled steel, a polymer, or another suitably fuel resistant material. The cap 104 may also be integrated with the skirt 106 or the two may be separable (e.g., with a threaded connection).

The cap 104 retains the self extinguishing mechanism 114 which may include a wick tube 108 surrounded by a sliding tube 110. A stationary tube 112 affixes to the cap 104 and surrounds the sliding tube 110 in a sliding relationship as explained in detail below. The cap 104 may comprise a polymer or an alloy. The cap 104 may provide a flame guard 116 in the form of a surface adjacent to the self extinguishing mechanism 114. The flame guard 116 provides for some degree of offset between the self extinguishing mechanism 114 and the rest of the cap 104, skirt 106, and/or sides of the fuel reservoir 102. The flame guard 904 (deleted) may serve to reduce temperatures of adjacent components by providing a longer path of thermal conductivity for heat transfer and some degree of physical isolation from flames. The flame guard 116 may provide a smooth or textured surface.

Figure 2:
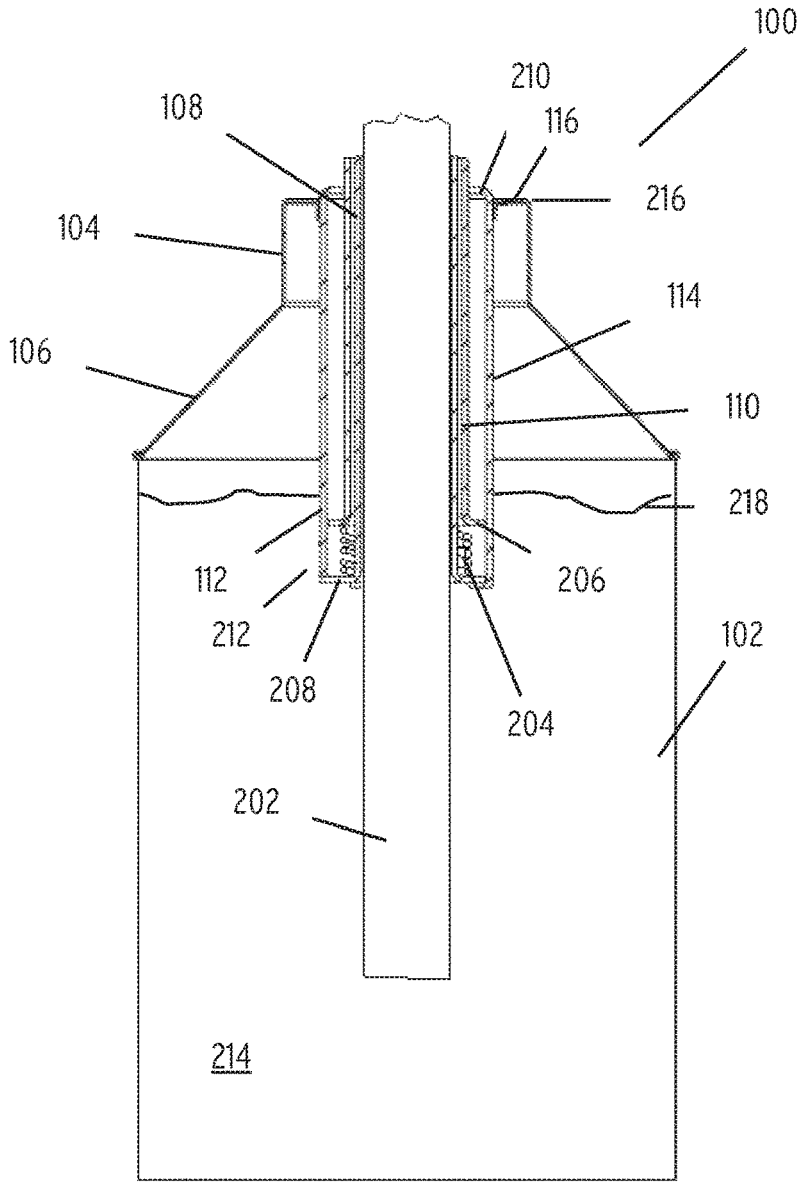
FIG. 2 is a side cutaway view of the canister of FIG. 1.

Referring now to FIG. 2, a side cutaway view of the self extinguishing canister 100 of FIG. 1 is shown. Here, the self extinguishing mechanism 114 can be seen to comprise the nested arrangement of the wick tube 108, surrounded by the sliding tube 110, surrounded by the stationary tube 112. In the present view, as in FIG. 1, the sliding tube 110 is in a retracted state such that the self extinguishing canister 100 is operational.

The stationary tube 112 is stationary with respect to the cap 104 and therefore the skirt 106 and fuel reservoir 102. The stationary tube 112 may be rigidly affixed to the cap 104 at the flame guard 116. The stationary tube 112 may have a generally cylindrical shape and extend from a lip 210 proximate the flame guard 116 to a lower shelf 208. The lower shelf 208 may be formed between the stationary tube 112 and the wick tube 108 and may be formed from a portion of the stationary tube 112, the wick tube 108, or both.

FIG. 2 illustrates the placement of a wick 202 extending from the fuel reservoir 102 through the wick tube 108 and somewhat beyond. In operation, depending upon fuel supply and desired burning characteristics, the wick 202 may be positioned to extend from about 0.25 inches to about 0.75 inches above the wick tube 108. The wick 202 may extend completely to the bottom of the fuel reservoir 102 in some embodiments. The wick 202 may be a woven fiberglass wick that is considered permanent (e.g., it will not be consumed during normal use).

The self extinguishing canister 100 is illustrated in FIG. 2 in a substantially upright position (e.g., tilted by no more than a few degrees). In such case, the sliding tube 110 is substantially retracted into the stationary tube 112 such that the wick 202 remains exposed. When the self extinguishing canister 100 is substantially upright, the sliding tube 110 terminates at approximately the same level as the wick tube 108. A biasing member 204 interposes the shelf 208 and a flange 206 defined on or near the bottom of sliding tube 110. When the self extinguishing canister 100 is substantially upright, the biasing member 204 is compressed by the weight of the sliding tube 110. The biasing member 204 may be a coil spring, as shown. It may wrap around the wick tube 108, as shown. In other embodiments, the biasing member 204 might be a leaf spring, or a series of individual coil springs spaced around the wick tube 108 interposing the flange 206 and shelf 208.

A flame guard height 216 denotes the uppermost surface of the flame guard 116 and the cap 104. The self extinguishing mechanism 114 is situated with the majority of its structure and mechanisms below this flame guard height 216 and extends into the fuel reservoir 102 to a lower depth 212. The fuel reservoir 102 contains a quantity of liquid torch fuel 214. The amount of fuel 214 in the fuel reservoir 102 will vary over time but the lower depth 212 of the self extinguishing mechanism 114 may be situated below a maximum fuel fill level 218. Having the self extinguishing mechanism 114 situated deeply in the fuel reservoir 102 reduces the overall size of the self extinguishing canister 100 to that of a fuel canister without any self extinguishing capabilities. It also allows the self extinguishing canister 100 to provide self extinguishing benefits with minimal increase in center of gravity.

Figure 3:
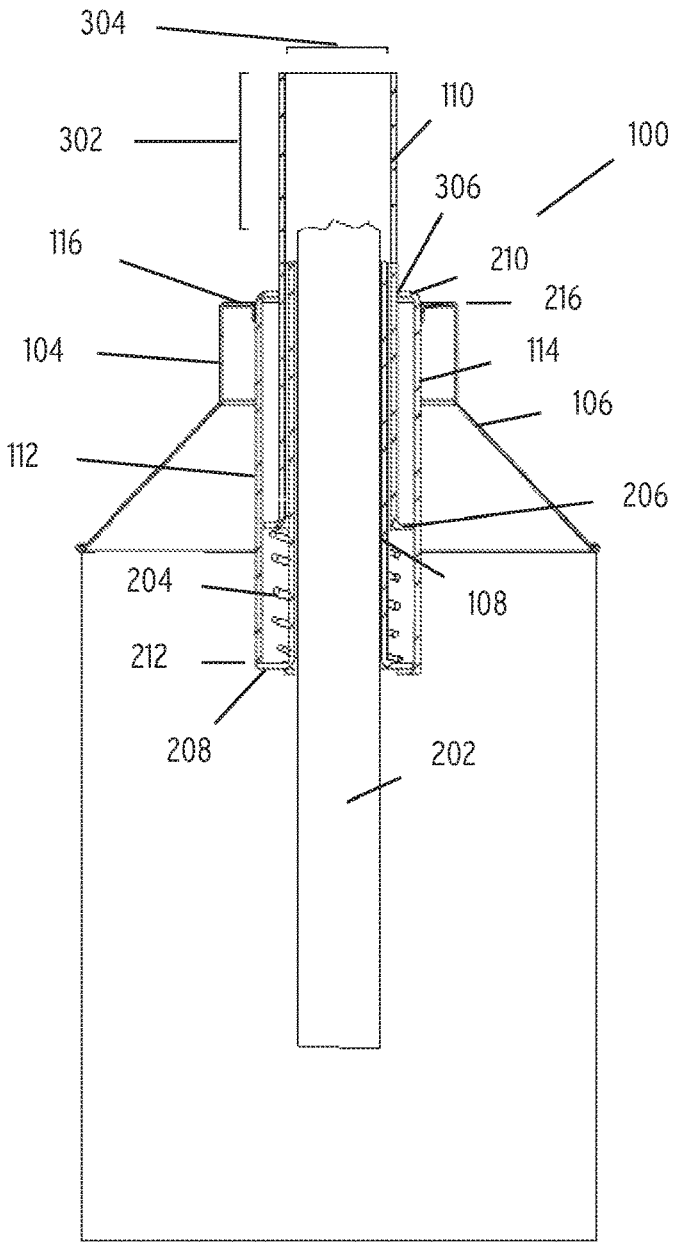
FIG. 3 is a side cutaway view of the canister of FIG. 1 shown with the self extinguishing mechanism activated.

Referring now to FIG. 3, a side cutaway view of the self extinguishing canister 100 is shown. In FIG. 3, the sliding tube 110 is shown extended. The sliding tube 110 may be constructed so as to have sufficient weight to fully compress biasing member 204 when the self extinguishing canister 100 is upright. If the weight of the sliding tube 110 is not sufficient to fully compress biasing member 204, the strength of the biasing member 204 can be selected, along with the height and weight of the sliding tube 110 such that when the self extinguishing canister 100 is substantially upright, the sliding tube 110 is retracted to approximately the same height relative to the wick 202 as the wick tube 108.

The configuration of the self extinguishing canister 100 as shown in FIG. 3 may correspond to the self extinguishing canister 100 having been tipped fully or partially onto its side. In such case, the biasing member 204 pressing against the 206 is able to overcome the weight of the sliding tube 110, thereby extending the sliding tube 110 into the extended position shown in FIG. 3. Here the sliding tube 110 extends beyond the previously exposed portion of the wick 202. In such a configuration, the wick 202 will quickly become starved of oxygen and any flame or combustion on the wick 202 will rapidly come to an end. In this respect, the sliding tube 110 acts as an automatically deployed wick snuffer.

It has been determined that, when the sliding tube 110 is only marginally larger in diameter than a diameter 304 of the wick 202, as it is in the present embodiment, any flame on the wick 202 will rapidly starve of oxygen and extinguish when the sliding tube 110 extends beyond the wick 202 by a height denoted 302 that is at least twice the diameter 304. Of course, the sliding tube 110 and other components of the self extinguishing mechanism 114 may be sized and configured such that the sliding tube 110 can extend more than twice the diameter 304 beyond the wick 202 but at the expense of a larger self extinguishing mechanism 114 overall, and slightly more displacement of fuel 214 in the fuel reservoir 102 by the self extinguishing mechanism 114.

The degree to which the self extinguishing canister 100 must tip or tilt in order to deploy the sliding tube 110 such that any flame is extinguished may vary depending upon a number of factors. One such factor is the strength or spring rate of the biasing member 204. Another factor is the weight of the sliding tube 110. In one embodiment, the biasing member 204 and sliding tube 110 are configured such that the sliding tube 110 extends fully if the self extinguishing canister 100 has tilted more than about 30 degrees from fully upright.

In some embodiments, maximum extension of the sliding tube 110 is not achieved until the self extinguishing canister 100 has tilted by greater than 45 degrees. In further embodiments still, the biasing member 204 and sliding tube 110 may be configured such that maximum extension is not achieved until the self extinguishing canister 100 is tilted approximately 90 degrees, which would correspond to the self extinguishing canister 100 having been tipped completely onto its side. Some embodiments perform in use such that maximum extension of the sliding tube 110 is assured by an approximately 90 degree (or greater) tilt accompanied by an impact that would correspond to the self extinguishing canister 100 having impacted the ground or other surface upon turning over completely.

In some embodiments, to further control or adjust the weight applied to the biasing member 204 in various positions, one or more weights (not shown) may be provided inside the self extinguishing mechanism 114 to bear upon the top of the flange 206 when the self extinguishing canister 100 is at least partially upright. These weights may be a free weights, such as a metallic sphere or ball bearing.

In the present embodiment, the stationary tube 112, sliding tube 110, and wick tube 108 are generally cylindrical and coaxial to one another. This provides for reliable and repeatable operation of the sliding tube 110 regardless of which side or direction the self extinguishing canister 100 tilts or falls toward. The lip 210 prevents loss of the sliding tube 110 or other components from inside the self extinguishing mechanism 114 as the flange 206 cannot pass out of the stationary tube 112 and an upper opening 306 of the stationary tube 112 is otherwise filled by the sliding tube 110, wick tube 108, and wick 202.

Although the wick tube 108 is fixed with respect to the stationary tube 112 (e.g., being fixed at shelf 208) room is provided between the wick tube 108 and stationary tube 112 at the upper opening 306 to allow the sliding tube 110 to slide freely out of the stationary tube 112. The upper opening 306 need only be so small as to prevent the flange 206 and any other interior components from being lost through the upper opening 306. Similarly, sliding tube 110 and the wick tube 108 fit next to one another in a sliding relationship but should not be so closely fitted that the sliding tube 110 is likely to become stuck to the wick tube 108 if any moisture or expected degree of corrosion is present. The stationary tube 112 and the wick tube 108 are spaced apart far enough to accommodate the flange 206 and biasing member 204 and allow these components to slide within the stationary tube 112 as needed.

Figure 4:
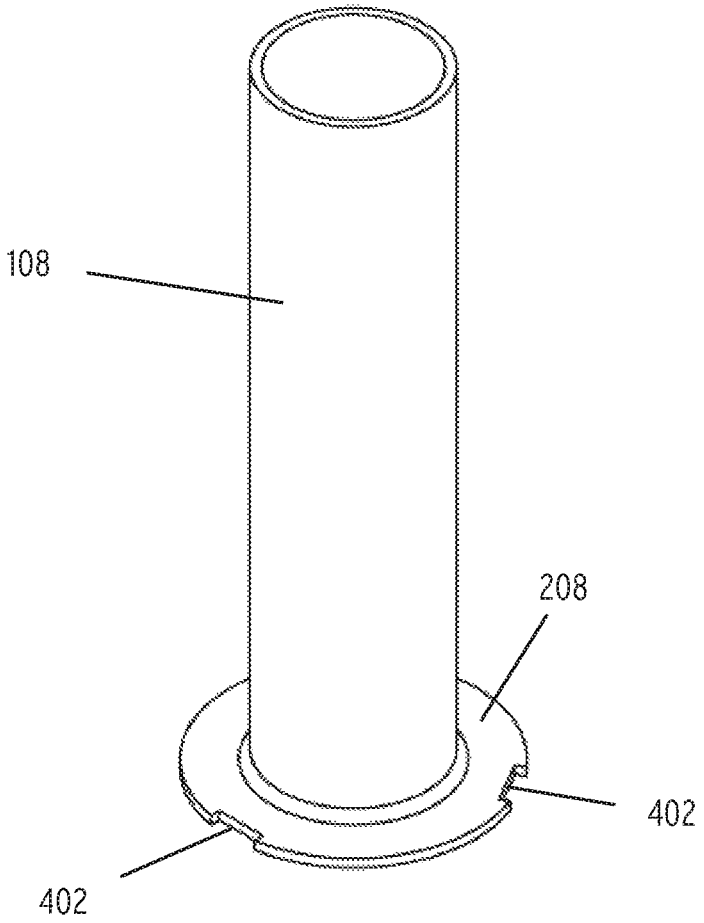
FIG. 4 is a perspective view of a wick tube according to aspects of the present disclosure.

Referring now to FIG. 4 a perspective view of the wick tube 108 is shown. The wick tube 108 retains the wick 202 (FIG. 2) in a friction fit relationship and should be sized with respect to the wick 202 accordingly (or vice versa). In the present embodiment, the shelf 208 extends laterally from the wick tube 108. A number of slots 402 may be defined radially about the shelf 208 to aid in fitting the wick tube 108 rigidly with respect to the stationary tube 112.

Figure 5:
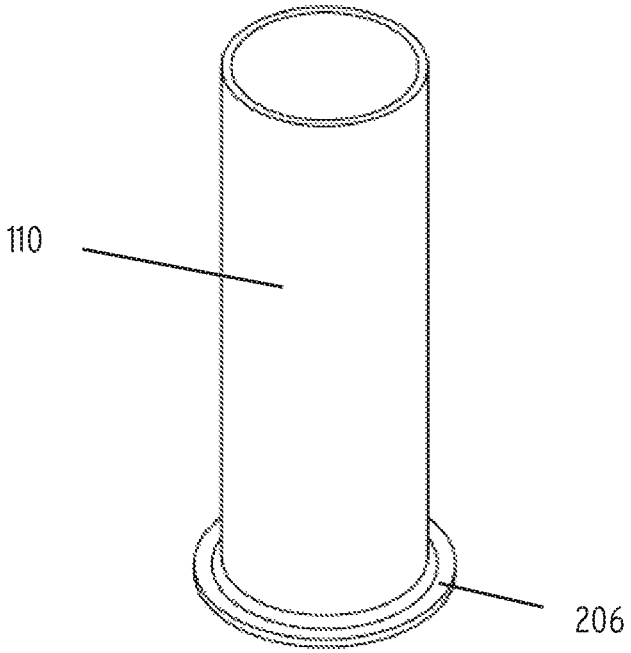
FIG. 5 is a perspective view of a sliding tube utilized as a snuffer according to aspects of the present disclosure.

Referring now to FIG. 5 a perspective view of the sliding tube 110 is shown. The sliding tube 110 may be integrated with the flange 206 which circumscribes a lower portion of the sliding tube 110 as shown.

Figure 6:
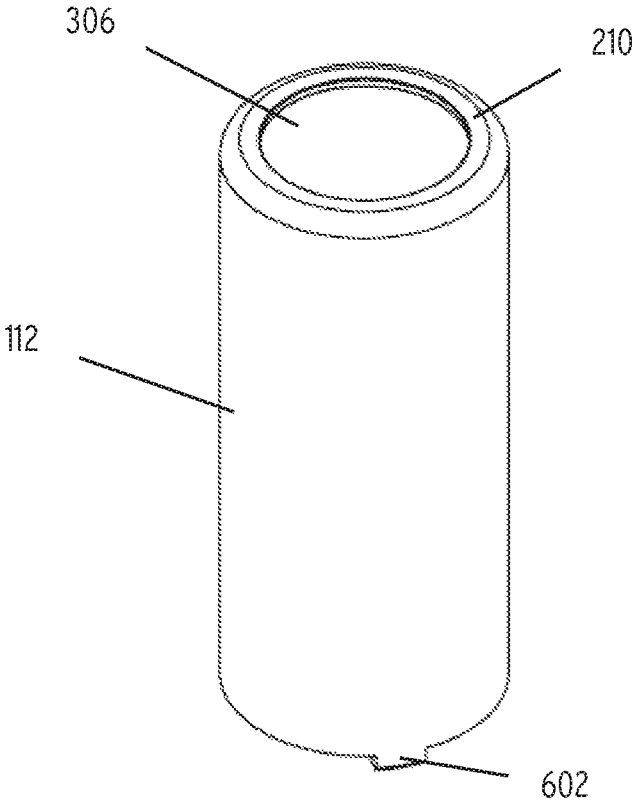
FIG. 6 is a perspective view of an internally housed stationary tube according to aspects of the present disclosure.

Referring now to FIG. 6 a perspective view of an internally housed stationary tube 112 according to aspects of the present disclosure is shown. The stationary tube 112 is internally housed within the self extinguishing canister 100 as described previously. The stationary tube 112 houses the other components comprising the self extinguishing mechanism 114. The stationary tube 112 remains stationary with respect to the fuel reservoir 102 and the other components of the self extinguishing mechanism 114 move within the stationary tube 112 or are otherwise housed by it.

The stationary tube 112 may be cylindrical in shape defining the upper opening 306 inside a lip 210 on an upper end thereof. The lip 210 is sized to restrain the flange 206 of the sliding tube 110 from escaping from the stationary tube 112.

A lower end of the stationary tube 112 may provide a one or more tabs 602. These fit into the slots 402 (FIG. 4) on the wick tube 108 to aid in alignment or assembly. The tabs 602 may be bent inward to retain the wick tube 108 and other components of the self extinguishing mechanism 114 inside the stationary tube 112. The stationary tube 112 may be sealed or welded to the stationary tube 112 such that fuel is not likely to enter the space between the stationary tube 112 and wick tube 108. Not all embodiments provide tabs 602 or slots 402.

The self extinguishing canister 100 in general and the self extinguishing mechanism 114 in particular rely upon oxygen starvation of the flame to provide the self extinguishing operations. The wick 202, even when extinguished, will retain enough fuel to operate if re-fired in the presence of sufficient oxygen. Accordingly, even if the stationary tube 112 is not sufficiently sealed to the wick tube 108 so as to prevent all fuel leaks it will not affect the ability of the self extinguishing canister 100 or the self extinguishing mechanism 114 to extinguish the wick 202 if tipped sufficiently to deploy the sliding tube 110.

Figure 7:
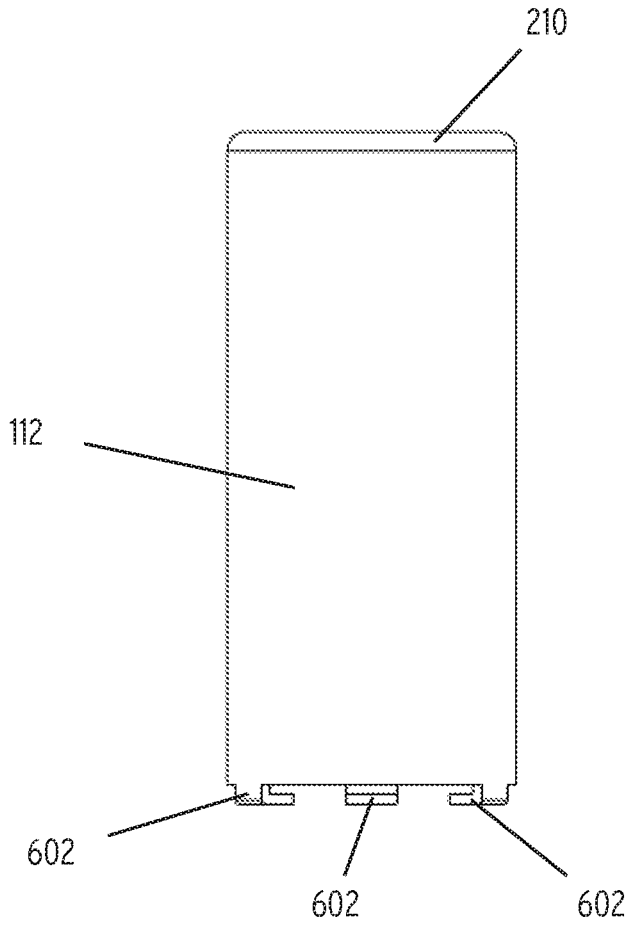
FIG. 7 is a side view of the stationary tube of FIG. 6.

Referring now to FIG. 7 a side view of the stationary tube 112 is shown. Here it can be seen that, in the present embodiment, there are three tabs 602 spaced roughly equidistantly around the lower end of the stationary tube 112. This spacing matches the spacing of the slots 402 of the stationary tube 112 (FIG. 4). The tabs 602 are shown bent inwardly but they would not normally be bent until the stationary tube 112 and other components of the self extinguishing mechanism 114 are assembled into the 112 as shown, for example, in FIGS. 2-3.

Figure 8:
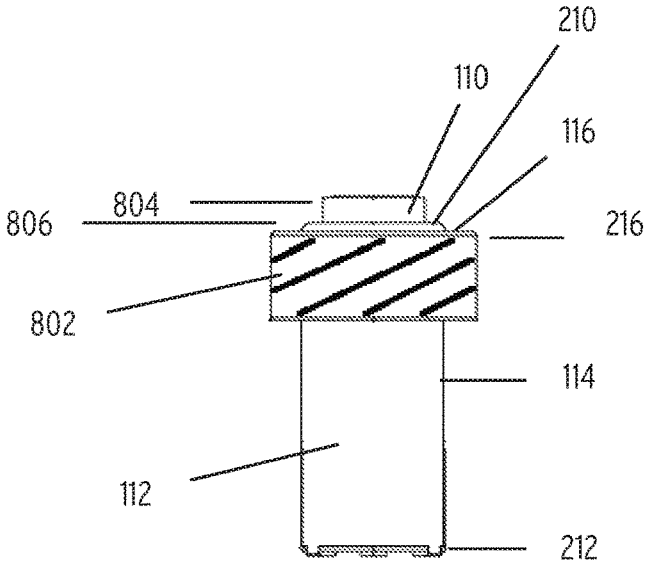
FIG. 8 is a side view of a self extinguishing mechanism with threaded cap according to aspects of the present disclosure.

Referring now to FIG. 8 a side view of a self extinguishing mechanism 114 with threaded cap 802 according to aspects of the present disclosure. The self extinguishing mechanism 114 here is identical to that previously described except that a threaded cap 802 is rigidly affixed to the self extinguishing mechanism 114. This provides for selective attachment of the self extinguishing mechanism 114 to a torch or fuel reservoir providing a threaded fitting. As described with respect to FIGS. 1-3, the skirt 106 of those embodiments may be threaded to effect selective attachment of a self extinguishing mechanism 114 having affixed thereto a threaded cap 802. For purposes of the present disclosure, selective means that the condition may be effected by a user. For example, the self extinguishing mechanism being selectively attachable to a torch or reservoir means the user may manipulate these objects to be attached to one another (e.g., as by threaded fitting) or detached from one another.

The side view of FIG. 8 illustrates that, owing to the fact that the lip 210 may be radiused or curved in its connection to the otherwise straight sides of stationary tube 112, a lip height 806 (which denotes an uppermost surface of the lip 210) may be slightly higher than the flame guard height 216. A slight elevation of the lip height 806 relative to the flame guard height 216 also allows for somewhat less heat transfer to the threaded cap 802 (or cap 104). Notwithstanding this slight difference in heights, the majority of the stationary tube 112, and indeed the whole self extinguishing mechanism 114, is below the 216, which represents the highest point of the threaded cap 802 (or cap 104).

Having the self extinguishing mechanism 114 situated low with respect to the threaded cap 802 (or the cap 104), or stated another way, having the threaded cap 802 situated toward the upper end of the self extinguishing mechanism 114, near the lip 210, means that the self extinguishing mechanism 114 will be situated lower inside the fuel reservoir 102. As shown, for example, in FIG. 2, this may place the lower depth 212 below the fuel fill level 218. Such an arrangement minimizes the effect the self extinguishing mechanism 114 has on the center of gravity of the self extinguishing canister 100, while still providing the benefits of the self extinguishing mechanism 114.

As can be seen in FIG. 8, a maximum tube height 804 may be slightly above the lip height 806. The tube height 804 represents the maximum height of the stationary tube 112 or the sliding tube 110 when retracted. The height of the stationary tube 112 will generally be approximately the same as the height of the sliding tube 110 when retracted (although in some embodiments a slight elevation or depression of the sliding tube 110 relative to the stationary tube 112 may be observed upon retraction). The tube height 804 may be slightly elevated with respect to the lip height 806 and/or the flame guard height 216, which can provide for ease of lighting of wick 202 and also serve to keep combustion on the wick 202, and heat resulting from combustion away from the threaded cap 802 (or cap 104). The slight elevation of tube height 804 may be acceptable in terms of its very minor effect upon center of gravity, particularly owing to the fact that the heavier lower ends of the wick tube 108 (providing shelf 208) and the sliding tube 110 (providing flange 206) will remain lower, and inside the stationary tube 112.

Figure 9:
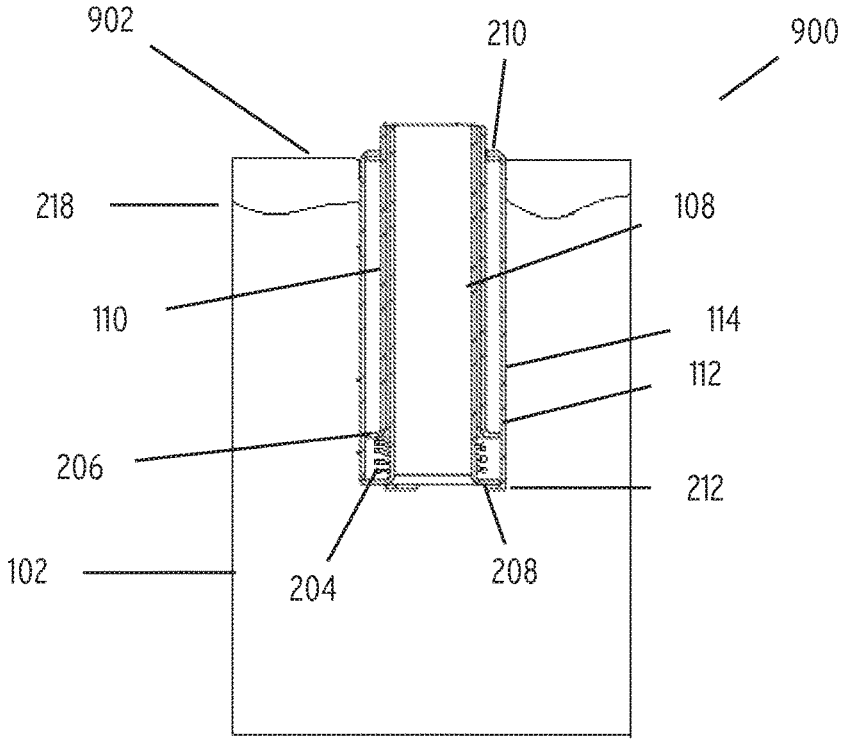
FIG. 9 is a perspective view of another embodiment of self extinguishing canister torch for a liquid fuel burning torch according to aspects of the present disclosure.

Referring now to FIG. 9, a perspective view of another embodiment of a self extinguishing canister 900 for a liquid fuel burning torch according to aspects of the present disclosure is shown. The self extinguishing canister 900 of FIG. 9 employs a self extinguishing mechanism 114 as with previous embodiments. However, the self extinguishing mechanism 114 of the self extinguishing canister 900 is not affixed to a cap, threaded or otherwise. The self extinguishing mechanism 114 here attaches directly to a canister top 902 on the fuel reservoir 102. The canister top 902 may have a separate fill opening (not shown) allowing access to the fuel reservoir 102.

The self extinguishing mechanism 114 affixes to the canister top 902 near the top of stationary tube 112, although this may still be slightly below the uppermost level of the lip 210 due to the geometry of the stationary tube 112, as previously described. Once again the lower depth 212 of the self extinguishing mechanism 114 may, at least at times, be lower than fuel fill level 218. Any leakage of fuel into the space defined between the self extinguishing mechanism 114 and wick tube 108 may be minimized by the connection between these two components. As discussed, even if leakage occurs, the self extinguishing mechanism 114 will still be effective owing to the mechanism of operation being oxygen deprivation of the wick 202 rather than interruption of fuel supply.

Figure 10:
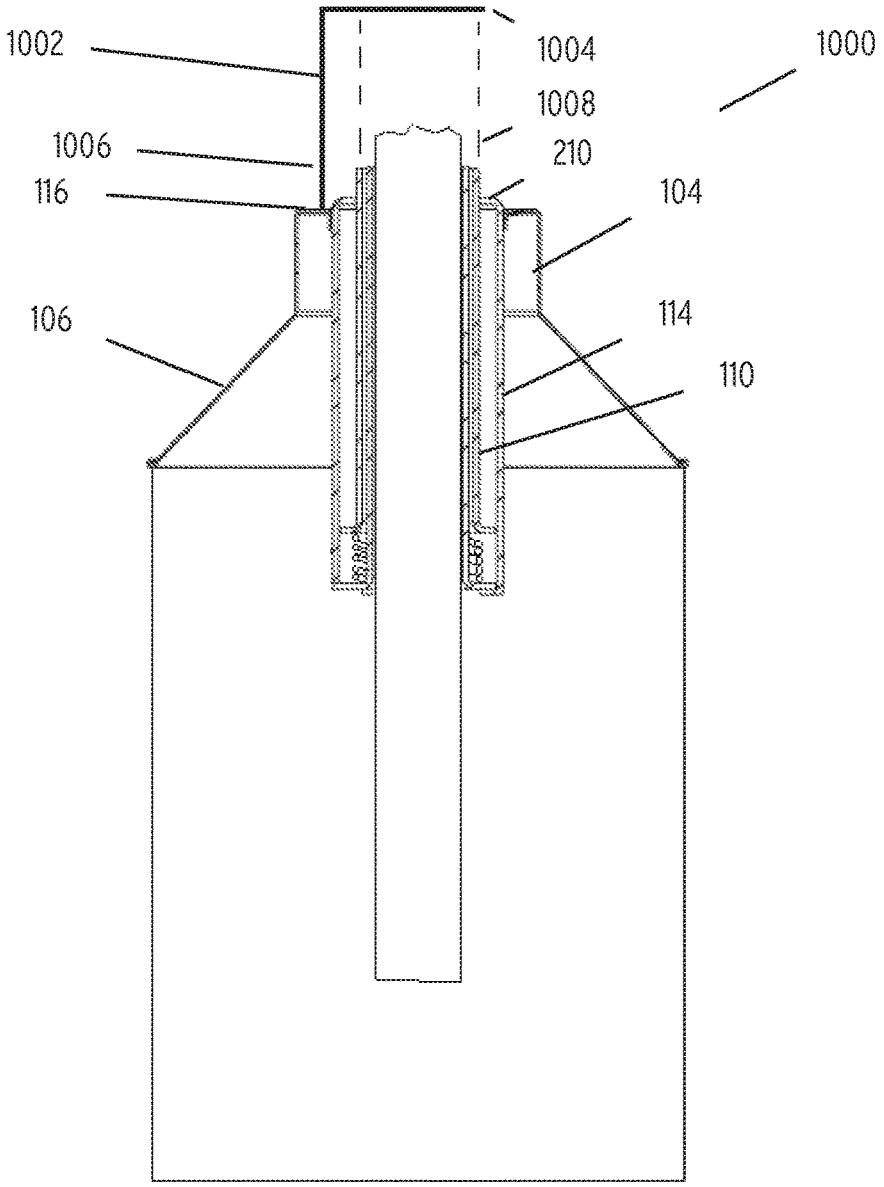
FIG. 10 is a side cutaway view of another embodiment of a self extinguishing canister according to aspects of the present disclosure.

Referring now to FIG. 10, a side cutaway view of another embodiment of a self extinguishing canister 1000 for use with a liquid fueled torch is shown. The self extinguishing canister 1000 is similar to the self extinguishing canister 100 but with the addition of a stationary snuffer 1002. The stationary snuffer 1002 may be made from a metal or other fire resistant material and be placed to sit partially above the wick 202 even as it burns. The stationary snuffer 1002 comprises a remote snuffer cap 1004 located superior to the wick 202 and held in place by a stationary arm 1006. In the present embodiment, the stationary arm 1006 is affixed to the cap 104, possibly connecting to the flame guard 116. In other embodiments, the stationary snuffer 1002 may connect elsewhere (e.g., to lip 210, skirt 106, canister top 902 shown in FIG. 9, or other stable component). The remote snuffer cap 1004 may be sized to match, or be slightly larger than, the diameter of the sliding tube 110. It may have a rounded shape or another shape sufficient in size to cover the top of the sliding tube 110. In this manner, when sliding tube 110 extends, it will meet against remote snuffer cap 1004 as shown by dotted lines 1008. The stationary arm 1006 is sized appropriately to provide proper elevation of remote snuffer cap 1004 to allow the wick 202 to burn freely when the sliding tube 110 is retracted. As previously described, the sliding tube 110 alone can provide reliable extinguishing of the wick 202 if sized appropriately. Use of the stationary snuffer 1002 allows for more variation in sizes of wicks and sliding tubes while still providing reliable operation in extinguishing the wick 202 via oxygen deprivation.

Figure 11:
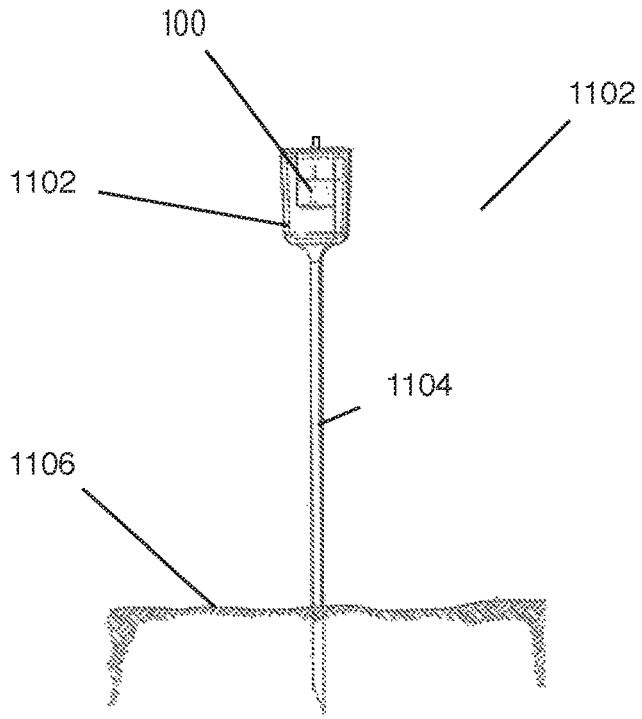
FIG. 11 is a side view of a liquid fuel burning torch according to aspects of the present disclosure.

Referring now to FIG. 11, a side view of a liquid fuel burning torch 1100 according to aspects of the present disclosure is shown. The torch 1100 may be suitable for use with the various self extinguishing canisters of the present disclosure (e.g., such as self extinguishing canister 100, self extinguishing canister 900, or self extinguishing canister 1000). The torch 1100 has a torch body 1102 in the form of a receptacle for the appropriate self extinguishing canister (shown here as self extinguishing canister 100). The torch body 1102 may be mounted on a mounting pole 1104, which may have an opposite end planted into a ground surface 1106. The previously-described self extinguishing mechanisms of the self extinguishing canister 100 will stop combustion by deployment of the sliding tube 110 if the torch 1100 overturns or upsets. It will be appreciated that the torch 1100 may take other forms. For example, a base may be provided for resting the torch 1100 on a stable surface rather than being planted in the ground surface 1106. The torch 1100 could also be a tabletop torch providing much less elevation than shown but still able to self extinguish upon becoming overturned or upset.

It is to be understood that the terms "including", "comprising", "consisting" and grammatical variants thereof do not preclude the addition of one or more components, features, steps, or integers or groups thereof and that the terms are to be construed as specifying components, features, steps or integers.

If the specification or claims refer to "an additional" element, that does not preclude there being more than one of the additional element.

It is to be understood that where the claims or specification refer to "a" or "an" element, such reference is not be construed that there is only one of that element.

It is to be understood that where the specification states that a component, feature, structure, or characteristic "may", "might", "can" or "could" be included, that particular component, feature, structure, or characteristic is not required to be included.

Where applicable, although state diagrams, flow diagrams or both may be used to describe embodiments, the invention is not limited to those diagrams or to the corresponding descriptions. For example, flow need not move through each illustrated box or state, or in exactly the same order as illustrated and described.

Methods of the present invention may be implemented by performing or completing manually, automatically, or a combination thereof, selected steps or tasks.

The term "method" may refer to manners, means, techniques and procedures for accomplishing a given task including, but not limited to, those manners, means, techniques and procedures either known to, or readily developed from known manners, means, techniques and procedures by practitioners of the art to which the invention belongs.

For purposes of the instant disclosure, the term "at least" followed by a number is used herein to denote the start of a range beginning with that number (which may be a ranger having an upper limit or no upper limit, depending on the variable being defined). For example, "at least 1" means 1 or more than 1. The term "at most" followed by a number is used herein to denote the end of a range ending with that number (which may be a range having 1 or 0 as its lower limit, or a range having no lower limit, depending upon the variable being defined). For example, "at most 4" means 4 or less than 4, and "at most 40%" means 40% or less than 40%. Terms of approximation (e.g., "about", "substantially", "approximately", etc.) should be interpreted according to their ordinary and customary meanings as used in the associated art unless indicated otherwise. Absent a specific definition and absent ordinary and customary usage in the associated art, such terms should be interpreted to be ±10% of the base value.

When, in this document, a range is given as "(a first number) to (a second number)" or "(a first number)-(a second number)", this means a range whose lower limit is the first number and whose upper limit is the second number. For example, 25 to 100 should be interpreted to mean a range whose lower limit is 25 and whose upper limit is 100. Additionally, it should be noted that where a range is given, every possible subrange or interval within that range is also specifically intended unless the context indicates to the contrary. For example, if the specification indicates a range of 25 to 100 such range is also intended to include subranges such as 26-100, 27-100, etc., 25-99, 25-98, etc., as well as any other possible combination of lower and upper values within the stated range, e.g., 33-47, 60-97, 41-45, 28-96, etc. Note that integer range values have been used in this paragraph for purposes of illustration only and decimal and fractional values (e.g., 46.7-91.3) should also be understood to be intended as possible subrange endpoints unless specifically excluded.

It should be noted that where reference is made herein to a method comprising of two or more defined steps, the defined steps can be carried out in any order or simultaneously (except where context excludes that possibility), and the method can also include one or more other steps which are carried out before any of the defined steps, between two of the defined steps, or after all of the defined steps (except where context excludes that possibility).

Thus, the present invention is well adapted to carry out the objectives and attain the ends and advantages mentioned above as well as those inherent therein. While presently preferred embodiments have been described for purposes of this disclosure, numerous changes and modifications will be apparent to those of ordinary skill in the art. Such changes and modifications are encompassed within the spirit of this invention as defined by the claims.

What is claimed is:

1. A self extinguishing torch mechanism comprising:

a stationary tube with an opening at an upper end thereof;

a wick tube concentrically rigidly affixed inside the stationary tube defining a space therebetween;

a sliding tube situated coaxially around wick tube the within the space defined between the wick tube and stationary tube;

a biasing member that extends the sliding member through the opening at the upper end of the stationary tube when the stationary tube is overturned;

a flange on a lower portion of the sliding tube extending away from the sliding tube and interfacing with the biasing member;

a lip circumscribing the opening on the upper end of the stationary tube and defining the opening at a size that allows an upper portion of the sliding tube to extend through the opening but retains the flange within the stationary tube.

2. The self extinguishing torch mechanism of claim 1, further comprising a cap affixed at an upper end of the stationary tube and retaining the stationary tube at least partially inside a liquid fuel reservoir.

3. The self extinguishing torch mechanism of claim 1, further comprising a shelf between the stationary tube and the wick tube demarcating a lower end of the space defined between the stationary tube and wick tube.

4. The self extinguishing torch mechanism of claim 1, wherein the biasing member comprises a coil spring surrounding the wick tube and pressing against the shelf and the flange to provide an upward extending force to the sliding tube when the sliding tube contacts the coil spring.

5. A self extinguishing torch mechanism comprising:

a stationary tube with an opening at an upper end thereof;

a wick tube concentrically rigidly affixed inside the stationary tube defining a space therebetween;

a sliding tube situated coaxially around wick tube the within the space defined between the wick tube and stationary tube; and a biasing member that extends the sliding member through the opening at the upper end of the stationary tube when the stationary tube is overturned;

wherein the biasing member extends the sliding tube beyond the wick tube by a distance that is at least twice an internal diameter of the wick tube.

6. The self extinguishing torch mechanism of claim 1, further comprising a remote snuffer cap situated superior to the wick tube such that the sliding tube contacts the remote snuffer cap when extended by the biasing member when the stationary tube is overturned.

7. A self extinguishing torch canister comprising:

a liquid torch fuel reservoir; and a cap atop the liquid fuel torch reservoir retaining a self extinguishing mechanism at least partially inside the liquid fuel torch reservoir, the self extinguishing mechanism comprising:

a stationary tube affixed to the cap and defining an opening through the cap;

a wick tube retained inside stationary tube providing passage for a wick from outside the liquid torch fuel reservoir to inside the liquid torch fuel reservoir;

a space defined inside the stationary tube and between the stationary tube and the wick tube;

a sliding tube surrounding the wick tube and freely slidable on the wick tube to extend through the opening through the cap; and a biasing member providing an upward biasing force against the siding tube;

wherein, the sliding tube acts against the biasing member under force of gravity to remain in a first retracted position relative to the stationary tube when the liquid torch fuel reservoir remains upright; and wherein the sliding tube has a second extended position where the sliding tube is extended through the opening through the cap and beyond the wick tube by a distance at least twice an inside diameter of the wick tube.

8. The self extinguishing torch canister of claim 7, wherein the cap and the liquid torch fuel reservoir are threaded to allow the cap and the self extinguishing mechanism to be selectively attached and detached from the liquid torch fuel reservoir.

9. The self extinguishing torch canister of claim 7, wherein the liquid torch fuel reservoir has a maximum fuel fill level that is higher inside the liquid fuel torch reservoir than a lower depth of the self extinguishing mechanism.

10. The self extinguishing torch canister of claim 7, wherein the sliding tube is forced by the biasing member to extend through the opening through the cap to the second extended position when the liquid torch fuel reservoir departs from upright by greater than a predetermined angle.

11. The self extinguishing torch canister of claim 7, wherein the sliding tube is forced by the biasing member to extend through the opening through the cap to the second extended position when the liquid torch fuel reservoir departs from upright by greater than a predetermined angle and impacts a ground surface.

12. The self extinguishing torch canister of claim 7, wherein the biasing member comprises a coil spring wound around the wick tube.

13. The self extinguishing torch canister of claim 12, further comprising a flange on the sliding tube, the flange at least partially compressing the coil spring when the liquid torch fuel reservoir is in an upright position.

14. The self extinguishing torch canister of claim 13, further comprising a lip on the stationary tube, the lip being sized to retain the flange and prevent the sliding tube from completely escaping the stationary tube.

15. The self extinguishing torch canister of claim 14, further comprising a shelf on a lower portion of the wick tube, the shelf connecting the wick tube to the stationary tube and providing a lower bearing surface for the coil spring.

16. The self extinguishing torch canister of claim 7, further comprising a stationary snuffer affixed to the cap and providing a remote snuffer cap superior to the wick tube such that the sliding tube contacts the remote snuffer cap when the sliding tube is in the second extended position.

* * * * *